United States Patent [19]

Tobias-Pader

[11] Patent Number: 4,915,667

[45] Date of Patent: Apr. 10, 1990

[54] ELASTIC SOCKET FOR LIGHT BULBS AND FUSES

[76] Inventor: Jesus E. Tobias-Pader, Montevideo #727, Col. Latinoamericana 252700, Saltillo, Coahuila, Mexico

[21] Appl. No.: 218,943

[22] Filed: Jul. 13, 1988

[51] Int. Cl.[4] ..... H01R 4/38

[52] U.S. Cl. ..... 439/257; 439/665; 439/667

[58] Field of Search ..... 439/253–257, 439/664–667, 735, 245

[56] References Cited

U.S. PATENT DOCUMENTS

| | | | |
|---|---|---|---|
| 1,104,577 | 7/1914 | Thomas | 439/257 |
| 1,187,301 | 6/1916 | Goodridge | 439/665 |
| 1,519,774 | 12/1924 | Eberhardt | 439/257 |
| 1,640,189 | 8/1927 | Hamiel | 439/257 |
| 1,663,264 | 3/1928 | Thompson | 439/735 |
| 1,928,657 | 10/1933 | Wolfe | 439/257 |
| 2,154,812 | 4/1939 | Hauser | 439/735 |

FOREIGN PATENT DOCUMENTS

| | | | |
|---|---|---|---|
| 1360607 | 3/1964 | France | 439/257 |

*Primary Examiner*—David Pirlot

*Attorney, Agent, or Firm*—Laurence R. Brown; Alfred J. Mangels

[57] ABSTRACT

A socket for light bulbs and fuses has a metallic cylinder bulb or fuse receptacle having a longitudinal opening extending from its opening end across the opposed edges of which the opposed free ends of a coil spring are attached to frictionally engage a bulb or fuse entered into the receptacle cylinder with the coil spring.

1 Claim, 1 Drawing Sheet

ELASTIC SOCKET FOR LIGHT BULBS AND FUSES

BACKGROUND OF THE INVENTION

There are several fixtures which operate as sockets or light bulb holders or fuse holders, which by their own characteristics allow the light bulb or fuse to be introduced, either screwing in or screwing out, but all the known fixtures have inconveniences due to the kind of material used (generally brass) as well as by the imperfection in coupling the light bulb or fuse to their respective holders. Sometimes they may get stuck, that is, it is either very difficult or in some cases it is impossible to screw the light bulb in or out, or to place them in an operating position.

By using this invention, said main problem is avoided, because the elastic element has provided elasticity to the internal section diameter, so it is sufficient just to pull the light bulb or fuse, out from the socket, or plug them in to put them in operation without any problem at all.

Another advantage of this invention is that a spring is placed at the socket's internal section, which undoubtedly is a lot more effective and reliable than the laminated springs used today in these kind of fixtures, because the latter laminated springs, as time passes by, start collapsing, avoiding a reliable contact between the light bulb's or fuse's anode and the laminated spring thereby making the fixture inoperable.

DESCRIPTION OF THE INVENTION

Figure 1:
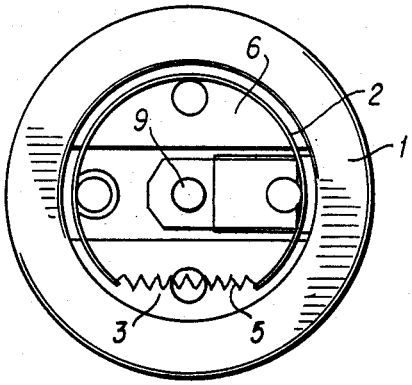
FIG. 1 shows a top plan view of the socket.
Figure 2:
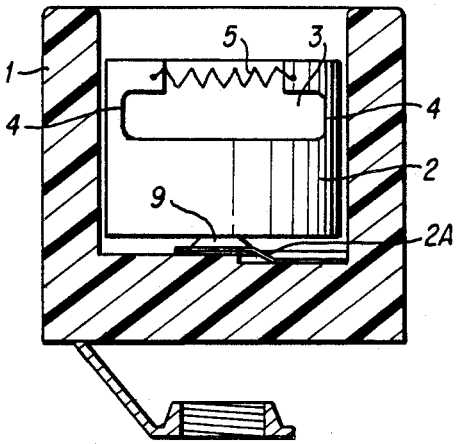
FIG. 2 shows is an elevated sectional view of the socket.
Figure 3:
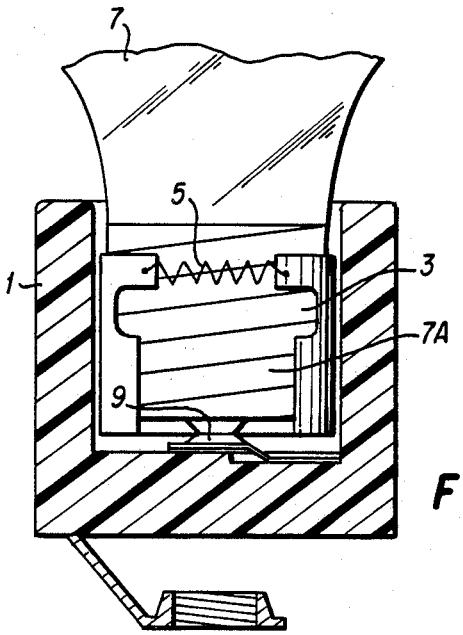
FIG. 3 shows an elevated sectional view in which bulb has been placed.

With reference to said figures, this socket is characterized by a hull (1) generally manufactured with bakelite or plastic and a metallic internal section forming a metallic cylinder (2) which can be smooth, threaded, or with notches (or grooves) or any other adequate retaining means, with a generally circular opening (3) having therein a longitudinal opening down the cylinder which makes this an incomplete opening. The opening edges on the sides (4) of the metallic cylinder (2) are connected in a precise manner (4) with opposed free ends of a coil spring (5) which allows the diameter of the internal section to expand (6) making it easier to introduce or to pull out the base (7A) and (8A) of the light bulb (7) or the fuse.

The metallic cylinder (2) forming the internal section can have an electrical contact spring (9) in its base which can be compressed or colapsed towards the bottom when the light bulb or fuse are introduced.

What I claim is:

1. A socket for light bulbs and fuses comprising in combination, an open ended metallic cylinder receptacle socket with a longitudinal opening presenting opposed edges about the open end of the cylinder defining an opening and a contact member at an opposite end of the cylinder for receiving said light bulbs and fuses said socket further having a coil spring with two opposed free ends attached across said longitudinal opening of the socket to the opposed edges to restrict the opening size, thereby to frictionally engage and retain light bulbs and fuses in place in the socket by means of said coil spring.

* * * * *